United States Patent [19]

Jones

[11] 4,119,181

[45] Oct. 10, 1978

[54] CARRYING CASE FOR ANIMAL CARE PRODUCTS

[76] Inventor: Constance C. Jones, 5906 Cahill Ave., Tarzana, Calif. 91356

[21] Appl. No.: 854,471

[22] Filed: Nov. 23, 1977

[51] Int. Cl.[2] ..... A45C 11/00

[52] U.S. Cl. ..... 190/51; 150/28 R

[58] Field of Search ..... 190/41 R, 42, 43, 48, 190/51; 150/28 R, 30, 32, 46

[56] References Cited

U.S. PATENT DOCUMENTS

| | | | |
|---|---|---|---|
| 1,638,837 | 8/1927 | Deitsch | 190/41 R |
| 2,584,048 | 1/1952 | Ramsey | 190/51 |
| 2,680,460 | 6/1954 | Hyman | 150/28 R |
| 3,232,397 | 2/1966 | McCoy | 190/51 |

*Primary Examiner*—Donald F. Norton
*Attorney, Agent, or Firm*—Jack C. Munro

[57] ABSTRACT

A carrying case for animal care products which is formed as a housing having an internal compartment. Access into the internal compartment is provided through the use of a hinged top wall with additional access being provided into the internal compartment through the use of a hinged front wall. Both the top wall and the front wall are securable to side walls of the housing and when so secured, the top wall is latchable to the front wall. Included within an internal compartment of the housing are individual subcompartments for supporting animal care devices. The internal compartment also includes implement securing means.

9 Claims, 5 Drawing Figures

CARRYING CASE FOR ANIMAL CARE PRODUCTS

BACKGROUND OF THE INVENTION

The field of this invention relates to containers, and more particularly to a container which is adapted to contain in an orderly manner a variety of animal care products which are to be used in the care and feeding of animals when the animal is transported to a locale away from the home locale.

In the care and feeding of the domesticated animal, such as a cat and a dog, there is an assortment of animal care products that are used. Besides the different types of food stuffs which will possibly be consumed by the animal during the course of a day, there are also devices such as combs, brushes, leashes, feeding dishes, blankets and possibly even a towel which are used daily in conjunction with the caring of the animal. Generally, within the home locale of the animal, these products are stored in a certain cabinet or other similar type of storing place within the home. At the present time, when the animal is transported away from the home, these products must be carried in some manner and are usually carried in one or more different types of traveling containers.

Prior to the present invention, there has been no known carrying container which has been specifically designed for the carrying and transporting of animal care products so that all of the products are located within a single container and the container itself is specifically designed to facilitate the retaining of each individual product and the use of the product.

SUMMARY OF THE INVENTION

The structure of this invention is believed to be summarily described in the Abstract Of The Disclosure and reference is to be had thereto.

The primary objective of this invention is to construct a carrying case for animal care products in which a wide assortment of animal care products is capable of being readily stored and transported within a single container.

A further objective of this invention is to construct a carrying case for animal care products in which the removal and use of the products is facilitated and the products, when stored within the device, are stored in such a manner as to permit ease of removal and return of the products to the carrying case.

DETAILED DESCRIPTION OF THE SHOWN EMBODIMENT

Figure 1:
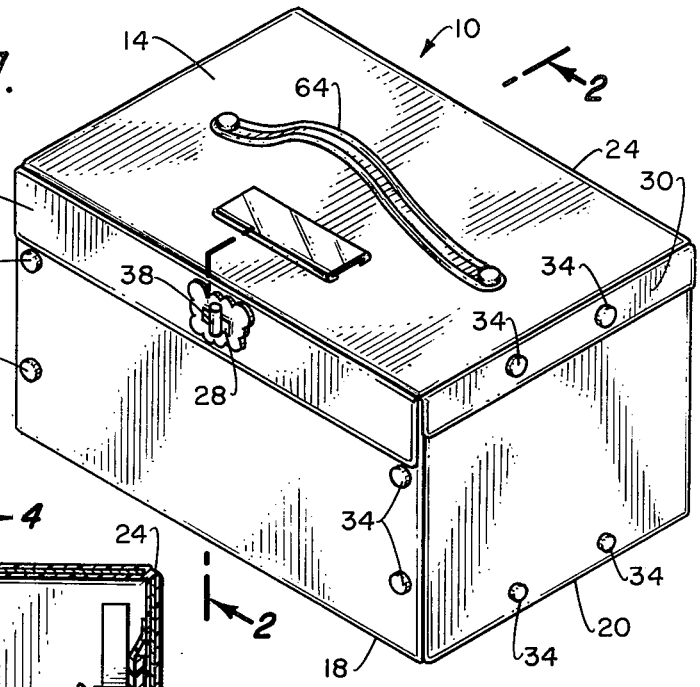
FIG. 1 is an exterior isometric view of the carrying case of this invention showing such in the closed position.
Figure 2:
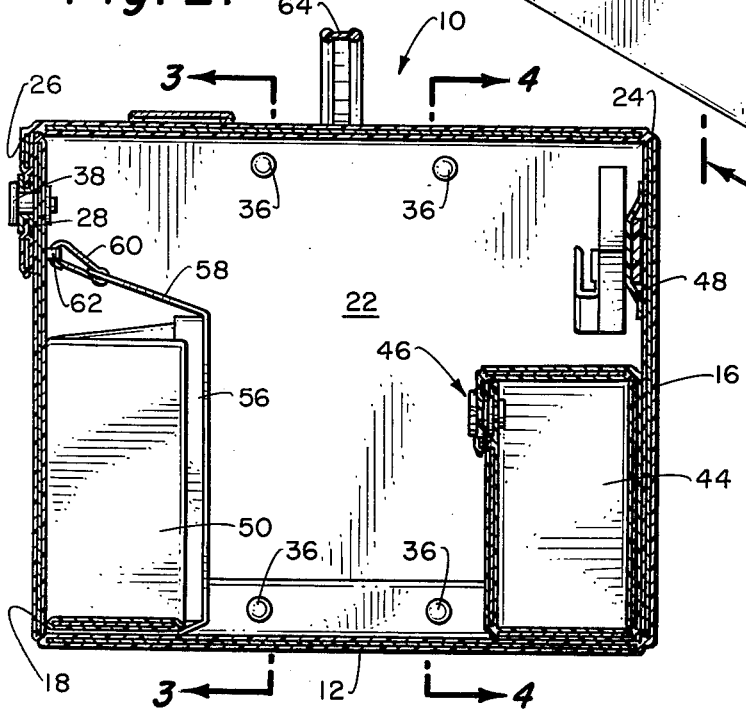
FIG. 2 is a side cross sectional view through the carrying case of this invention taken along line 2—2 of FIG. 1.
Figure 3:
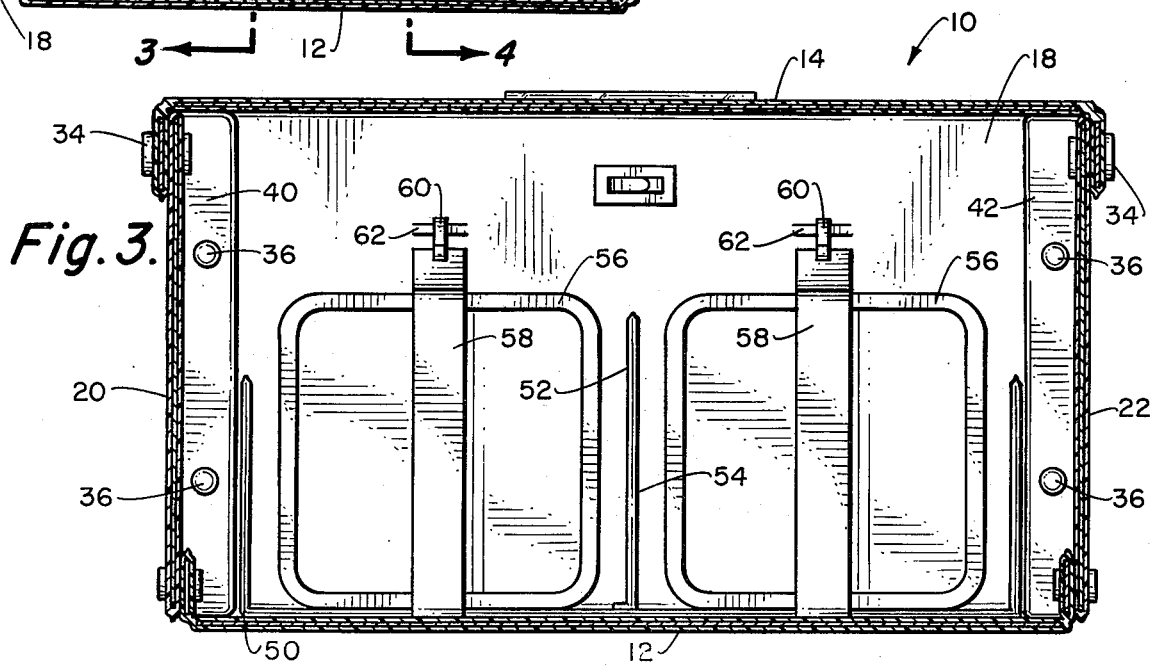
FIG. 3 is a cross sectional view taken along line 3—3 of FIG. 2 from the rear direction of the carrying case.
Figure 4:
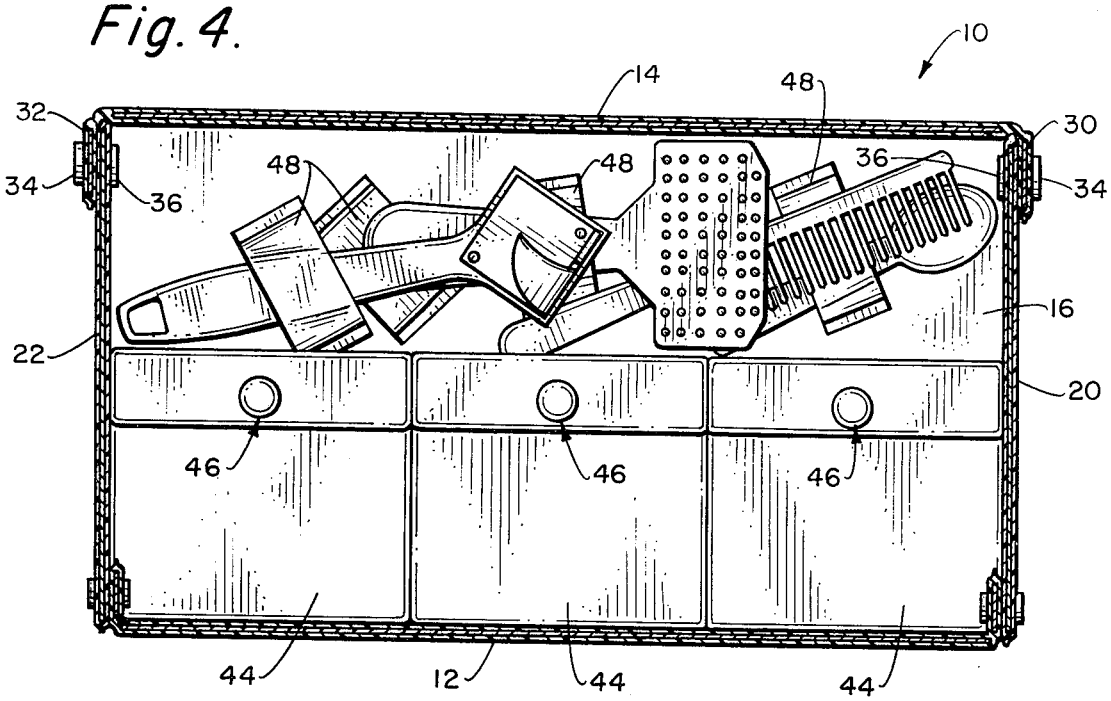
FIG. 4 is a cross sectional view taken along line 4—4 of FIG. 2 from the front direction of the carrying case.

Referring particularly to the drawings, there is shown the carrying case 10 of this invention which is composed generally in a basically rectangular configuration having an internal chamber which is formed by the interconnection of a series of panels, the bottom panel 12, the top panel 14, the back panel 16, the front panel 18 and oppositely located side panels 20 and 22. Each of the panels is constructed of a sheet material with each panel being rigid. The top panel 14 is hingedly connected along hinge line 24 to the back panel 16. The hinge connection 24 is established by thin sheets of plastic material forming the exterior surface of the panel 14 and this plastic material is integrally connected to the plastic material covering the panel 16.

The top panel 14 includes a front flap 26 which includes therein a latching aperture 28. The top panel 14 also includes side flaps 30 and 32. The side flaps 30 includes a pair of spaced apart female locking buttons 34. A similar pair of buttons 34 are located in a similar manner upon flap 32. Each of the locking buttons 34 are to cooperate with a male locking button 36. A pair of buttons 36 are located on the side panel 20 and are to cooperate with the corresponding female locking buttons located on the side flange 30 of the top panel 14. Similarly, the buttons 36 on the panel 22 are to cooperate with the buttons 34 located on the side panel 32. When the buttons 34 and 36 are so interlocked, the top panel 14 is securely fixed in a closed position covering the internal chamber within the carrying case 10. When the cover 14 is in the closed position, a latch pin 38 extends through the latching aperture 28 and is to be pivotable ninety degrees so as to latch the top panel 14 to the front panel 18. With the latch pin 38 extending through the aperture 28, there is to be a locking interconnection between buttons 34 located on the front panel 18 with buttons 36 located on flanges 40 and 42 of their respective side panels 20 and 22. The front panel 18 is hinged in a manner similar to what was previously described to the bottom panel 12.

Figure 5:
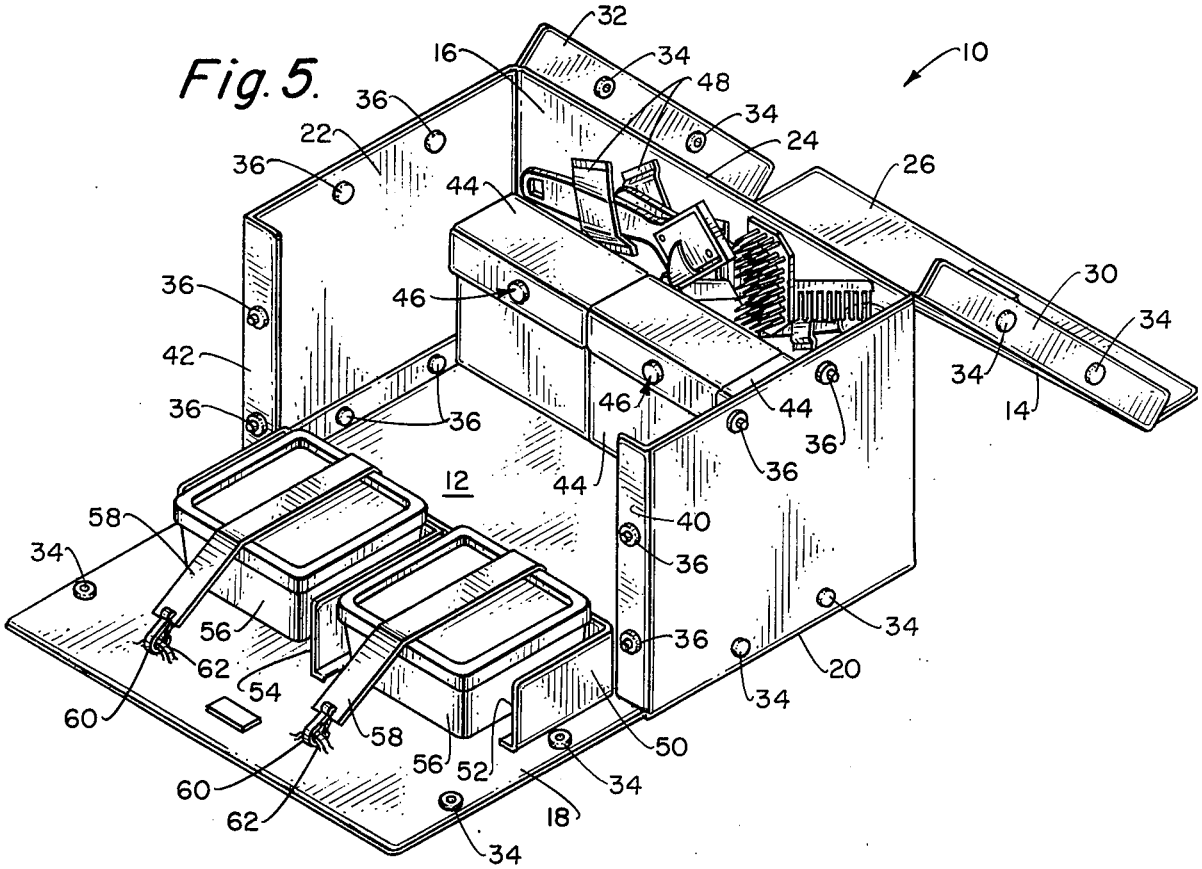
FIG. 5 is an isometric view of the carrying case of this invention showing the carrying case in the open position.

Access into the internal compartment of the carrying case 10 may be accomplished in a variety of different ways. Access can be provided by the hinging movement of the top panel 14 to the position shown in FIG. 5 of the drawings. Also, access into the internal chamber can be provided through the hinging of the front panel 18 also shown in FIG. 5 of the drawings. If it is desired to obtain additional access into the internal compartment, each of the side panels 20 and 22 could be pivoted in respect to the back panel 16.

Located upon the bottom panel 12 within the internal compartment are three in number of subcompartment or enclosed pockets 44. Each of the compartments 44 are identical and are latchable through a latching button assembly 46 which is similar to the previously described latching button assemblies 34 and 36.

Fixedly mounted on the back panel 16 within the internal compartment of the carrying case 10 are a plurality of bands 48. Each of the bands 48 is to facilitate retaining of an elongated implement, such as a brush, comb or the like. The handle of the implement is to be placed between the band 48 and the back panel 16.

Mounted on the inside of the front panel 18 is a short wall 50. The wall 50 forms a pair of compartments 52 and 54. Within each compartment is to be locatable a plastic closed container, such as container 56. The containers 56 will normally contain a foodstuff. Each container 56 is to be secured in position through the use of a flexible band 58 with there being a separate band for each container 56 and each band is to be located across the top of each container 56. When end of each band 56 is secured to the wall 50 with the free end of each band 58 including a latch 60 which is to connect with a latching member 62 formed on the inside surface of the panel 18.

What is claimed is:

1. A carrying case for animal care products comprising:

a housing having an internal compartment created by the interconnection of a bottom wall, a top wall, a front wall, a back wall and side walls, said bottom wall being fixedly secured to said back wall, said top wall being hingedly connected to said back wall for movement in respect thereto between a closed position and an open position, said front wall being hingedly connected to said bottom wall for movement in respect thereto between a closed position and an open position, with both said top wall and said front wall in their respective closed positions there being manually activatable locking means for securing both said top wall and said front wall to said side walls and latching means for interlocking said top wall and said front wall.

2. The carrying case as defined in claim 1 wherein:

said bottom wall being removably secured to said side walls.

3. The carrying case as defined in claim 2 including:

a plurality of subcompartments located within said internal compartment, each said subcompartment being completely enclosed and separate from each other.

4. The carrying case as defined in claim 3 including:

a plurality of enclosed containers removably located against said front wall within said internal compartment, each said enclosed container being separately removable from its location.

5. The carrying case as defined in claim 4 wherein:

said back wall having securing means for retaining elongated handle implements.

6. The carrying case as defined in claim 1 including:

a plurality of subcompartments located within said internal compartment, each said subcompartment being completely enclosed and separate from each other.

7. The carrying case as defined in claim 1 including:

a plurality of enclosed containers removably located against said front wall within said internal compartment, each said enclosed container being separately removable from its location.

8. The carrying case as defined in claim 1 including:

said back wall having securing means for retaining elongated handle implements.

9. The carrying case as defined in claim 1 including:

handle means attached to said top wall to facilitate portability of said carrying case.

* * * * *